US005279665A

United States Patent [19]

Yunovich et al.

[11] Patent Number: 5,279,665

[45] Date of Patent: Jan. 18, 1994

[54] INORGANIC FOUNDRY BINDER SYSTEMS AND THEIR USES

[75] Inventors: Yuily M. Yunovich, Westerville; Ruth A. Dudenhoefer; Heimo J. Langer, both of Columbus, all of Ohio

[73] Assignee: Ashland Oil, Inc., Columbus, Ohio

[21] Appl. No.: 785,364

[22] Filed: Oct. 30, 1991

[51] Int. Cl.[5] ..... C04B 9/04; C04B 35/04

[52] U.S. Cl. ..... 106/690; 106/691; 106/801; 106/38.3; 106/38.35; 501/111

[58] Field of Search ..... 106/38.27, 801, DIG. 7, 106/38.2, 38.22, 800, 690, 691, 38.35, 38.3; 501/94, 108, 112, 111

[56] References Cited

U.S. PATENT DOCUMENTS

| | | | |
|---|---|---|---|
| 3,923,525 | 10/1975 | Toeniskoetter et al. | 106/38.3 |
| 4,093,647 | 6/1978 | Lyass et al. | 106/38.35 |
| 4,111,705 | 9/1978 | Yunovich et al. | 106/38.35 |
| 4,430,441 | 2/1984 | Zhukovsky et al. | 501/109 |

FOREIGN PATENT DOCUMENTS

| | | |
|---|---|---|
| 952407 | 1/1979 | U.S.S.R. . |
| 792699 | 10/1983 | U.S.S.R. . |
| 1473899 | 4/1987 | U.S.S.R. . |
| 1423522 | 9/1988 | U.S.S.R. . |
| 1505904 | 9/1989 | U.S.S.R. . |
| 1600902 | 10/1990 | U.S.S.R. . |
| 1614884 | 12/1990 | U.S.S.R. . |

OTHER PUBLICATIONS

Ueda "Feed For Raising Marine Fishes and Shell Fish" (Dec. 14, 1988) JP 63-19623y.

Kingery, W. D., Cold-Selling Properties, Journal of the American Chemical Society, pp. 242-250 (Aug. 1980).

*Primary Examiner*—Mark L. Bell
*Assistant Examiner*—Paul Marcantoni
*Attorney, Agent, or Firm*—David L. Hedden

[57] ABSTRACT

This invention relates to inorganic no-bake foundry binder systems and their uses. The binder systems comprise as separate Part A and Part B components: (A) an aqueous solution of specified phosphoric acids, and (b) a mixture comprising (1) an iron oxide selected from the group consisting of (a) ferrous oxide, (b) ferroferric oxide, and (c) mixtures thereof and (2) magnesium oxide. The binder systems are used to prepare foundry mixes which are used to prepare foundry molds and cores. The foundry molds and cores are used to cast metals.

35 Claims, No Drawings

INORGANIC FOUNDRY BINDER SYSTEMS AND THEIR USES

TECHNICAL FIELD OF THE INVENTION

This invention relates to inorganic no-bake foundry binder systems and their uses. The binder systems comprise as separate Part A and Part B components: (A) an aqueous solution of specified phosphoric acids, and (B) a mixture comprising (1) an iron oxide selected from the group consisting of (a) ferrous oxide, (b) ferroferric oxide, and (c) mixtures thereof and (2) magnesium oxide. The binder systems are used to prepare foundry mixes which are used to prepare foundry molds and cores. The foundry molds and cores are used to cast metals.

BACKGROUND OF THE INVENTION

There is considerable interest in developing an inorganic foundry binder which has the performance characteristics of commercial organic foundry binders. Organic foundry binders, particularly those based upon polyurethane chemistry, have been used in the casting industry for several decades in both the no-bake and cold-box processes. This is because they produce foundry molds and cores with acceptable tensile strengths that shakeout of castings with relative ease. The castings prepared with these foundry molds and cores have a good surface finish with only minor defects.

Currently, the effects of organic foundry binders on the environment and health are under study. Consequently, there is an interest in considering alternative binders in case these studies are negative. Inorganic foundry binders are of particular interest because they are not subject to some of the concerns associated with organic foundry binders.

Various compositions of inorganic foundry binders are known. See for example U.S. Pat. No. 3,930,872 which describes an inorganic foundry binder comprising boronated aluminum phosphate and an oxygen-containing alkaline earth metal in specified amounts. Although these binders produce molds and cores that have adequate strength and shakeout easily from metal casting prepared with them, the binders are not very flowable and do not mix well with the aggregate. Furthermore, molds and cores prepared with these binders do not exhibit adequate humidity resistance.

As another example of an inorganic foundry binder, see U.S. Pat. No. 4,111,705 which describes an inorganic no-bake foundry binder comprising orthophosphoric acid, a ferrous oxide containing material, and a water-soluble alkali metal or ammonium salt of certain carboxylic acids. Another patent, U.S. Pat. No. 4,430,441, describes a no-bake inorganic foundry binder comprising from 95-99 weight percent of a refractory filler containing magnesium oxides, iron oxides, silicon oxides or mixtures thereof and from 1 to 5 weight percent of an organic acid having a specified dissociation constant.

The binders disclosed in these latter two patents do not fulfill needed requirements for them to be of practical use. They do not produce foundry molds and cores with adequate strengths that easily shakeout of the castings prepared with them, and the castings produced are not substantially free of major defects.

SUMMARY OF THE INVENTION

This invention relates to an inorganic foundry binder system comprising as separate Part A and Part B components:

(A) an aqueous solution of a phosphoric acid selected from the group consisting of orthophosphoric acid, pyrophosphoric acid, trimetaphosphoric acid, tetrametaphosphoric acid, polyphosphoric acid, and mixtures thereof; and (B) a mixture comprising:

(1) an iron oxide selected from the group consisting of:

(a) ferrous oxide, (b) ferroferric oxide, and (c) mixtures thereof and (2) magnesium oxide.

Preferably, the phosphoric acid is orthophosphoric acid and preferably a refractory form of magnesium oxide, most preferably dead-burned magnesite.

The invention also relates to foundry binders prepared by mixing the separate components of the system, foundry mixes prepared by mixing a foundry aggregate with the separate components of the system, a no-bake process for making foundry molds and cores with the foundry mixes, foundry molds and cores made by the process, a process for making metal castings with the foundry molds and cores, and the castings made by the process.

The molds and cores prepared with these foundry binder systems have excellent surface characteristics and do not promote veining in castings prepared with them. Additionally, the molds and cores readily shake out of castings prepared with them. The molds and cores also have adequate transverse strengths. Furthermore, the use of these binder systems is not likely to have a negative impact on human health and the environment.

BEST MODE AND OTHER MODES OF PRACTICING THE INVENTION

For purposes of this disclosure, a foundry binder system comprises the separate components of the foundry binder. The foundry binder is the mixture of these components. The foundry mix is the mixture of aggregate and foundry binder.

The Part A component of the foundry binder system comprises an aqueous solution of a phosphoric acid selected from the group consisting of orthophosphoric acid, pyrophosphoric acid, trimetaphosphoric acid, tetrametaphosphoric acid, polyphosphoric acid, and mixtures thereof. Generally, the concentration of the phosphoric acid in the aqueous solution is from 50 to 70 weight percent based upon the total weight of phosphoric acid and water, preferably from 55 to 65 weight percent, and most preferably 58 to 62 weight percent. The weight ratio of the Part A component (phosphoric acid and water) to the aggregate is generally from 1:100 to 10:100, preferably from 2:100 to 8:100, more preferably from 2:100 to 5:100.

The Part B component comprises a mixture of (1) an iron oxide selected from the group consisting of (a) ferrous oxide (FeO), (b) ferroferric oxide ($Fe_3O_4$), and (c) mixtures thereof, and (2) magnesium oxide. Minor amounts of other forms of iron oxide may be added to the iron oxide. The magnesium oxide used in the Part B component is preferably a refractory form of magnesium oxide, such as dead-burned periclase, most preferably dead-burned magnesite. The weight ratio of iron oxide to magnesium oxide in the Part B component is from 1:9 to 9:1, preferably from 1:1 to 1:4.

The Part B component (iron oxide and magnesium oxide) is generally added to the aggregate in an amount such that the weight ratio of Part B to aggregate is from 1:100 to 10:100, preferably from 1:100 to 5:100.

The weight ratio of the Part A component to the Part B component is generally from 5:1 to 1:1, preferably from 3:1 to 2:1.

The ratios set forth previously are calculated without taking into account any optional substances which may be added to the system.

Preferably, the foundry binder system will contain polyvinyl alcohol. It is believed that the addition of polyvinyl alcohol to the binder results in cores which have better strengths. The polyvinyl alcohol is preferably added to the Part A component in amount of about 1 weight percent to about 15 weight percent based upon the weight of the Part A component, preferably about 1 to about 6 weight percent based upon the weight of the Part A component.

Also preferably used in the foundry binder system is a chromite, preferably an iron chromite, most preferably chromite flour. It is preferable to add the chromite to the Part B component in an effective amount to improve the abrasion resistance of the foundry molds and cores made with the foundry mix, generally from 0-5 weight percent based upon the weight of the aggregate, preferably from 1-3 weight percent.

Optional substances, for example, urea, cellulose, citric acid, rubber lattices, cement, etc. may also be added to the foundry binder systems. Those skilled in the art of formulating inorganic foundry binders will know what substances to select for various properties and they will know how much to use of these substances and whether they are best incorporated into the Part A component, Part B component, or mixed with the aggregate as a separate component.

Foundry mixes are prepared from the foundry systems by mixing the foundry binder system with a foundry aggregate in an effective binding amount. Either Part A component or Part B component can be first mixed with the aggregate. It is preferred to mix the Part A component of the foundry binder system with the foundry aggregate before adding the Part B component.

Generally, an effective binding amount of binder system is such that the weight ratio of foundry binder system to aggregate is from 1:100 to 10:100, preferably 2:100 to 8:100.

The examples which follow will illustrate specific embodiments of the invention. These examples along with the written description will enable one skilled in the art to make and use the invention. It is contemplated that many equivalent embodiments of the invention will be operable besides these specifically disclosed.

EXAMPLES

In examples 1-6, the foundry molds are prepared by the no-bake process. The binder is used in the amount of 4.8 weight percent based upon the weight of the quartz sand (Wedron 540).

The Part A component (PAC) of the binder system used in the examples consisted of an aqueous solution (60%) of orthophosphoric acid. The Part B component (PBC) consisted of a mixture of iron oxide (IO) and dead-burned magnesite (MS). The iron oxide consisted of a mixture of FeO and $Fe_3O_4$ in a weight ratio of 60:40. The weight ratio of iron oxide to magnesite (IO/MS) for each of the examples is given in Table I.

The Part A component (3.2 weight percent based upon the weight of the sand) and sand were first mixed in a Hobart stainless steel mixer for several minutes until thoroughly mixed. Then the Part B component (1.6 weight percent based upon the weight of the sand) was added to the sand/Part A mixture and mixed for several minutes until both the Part A and Part B components were mixed thoroughly with the sand. The work time (WT) and strip time (ST) for the foundry mixes are given in Table I which follows.

The resulting foundry mixes were formed into test 5 cm.×1.2 cm. disc samples by hand ramming the mixture into a core box. The resulting samples were tested with the Universal Transverse Strength Machine PFG (GF) according to standard procedures to determine their transverse strengths. Measuring the transverse strength of the test samples enables one to predict how the mixture of aggregate and binder will work in actual foundry operations. The transverse strengths (TS) were measured 1 hour, 3 hours and 24 hours after curing at ambient conditions. Transverse strengths at these times are given in Table I along with the work times and strip times of the foundry mixes.

Examples 4-6 also contained polyvinyl alcohol (PVA) in the Part A component. The amount of polyvinyl alcohol is based on the total amount of Part A component and is specified in Table I.

TABLE I

| EX | IO/MS | PVA | WT/ST | | 1 hr/TS | 3 hr/TS | 24 hr/TS |
|---|---|---|---|---|---|---|---|
| 1 | 1:4 | 0 | 3.5 | 13 | 92 | 191 | 238 |
| 2 | 1:1 | 0 | 5 | 11 | 66 | 148 | 200 |
| 3 | 1:4 | 3.0 | 8 | 17 | 59 | 290 | 330 |
| 4 | 1:1 | 3.0 | 9 | 22 | 65 | 209 | 235 |
| 5 | 1:4 | 6.6 | 7 | 14 | 151 | 350 | 361 |
| 6 | 1:4 | 10.8 | 8 | 14 | 125 | 357 | 425 |

The shakeout of the foundry molds made in accordance with Example 4 was measured when these molds and cores were used to make aluminum castings. In order to determine shakeout, a 7" disk core assembly was prepared from the sand mix to use in the "shakeout test" described by W. L. Tordoff et al. in *AFS Transactions*. "Test Casting Evaluation of Chemical Binder Systems", Vol. 80-74, p. 157-158 (1980), which is hereby incorporated by reference. Over several trials, the shakeout ranged from about 8 to 11 seconds.

Examples 7-8 illustrate the effects of using chromite in the binder system. Example 7 was carried out along the lines of Example 4. Example 8 was carried out in the same manner as Example 7 except two percent by weight of chromite flour, based upon the weight of the sand, was added to the Part B component. Additionally, 3.5%, based upon the sand, of Part A was used instead of 3.2%. The results are summarized in Table II below. The abbreviation (AR) stands for abrasion resistance.

Abrasion resistance (AR) was measured by the "Core Abrasion Testing Apparatus, Type PAZ", which is manufactured by George Fisher. Essentially two disk samples are situated so that one moves against another stationary disk. After a fixed period of time, the disks are weighed to determine weight loss. A lower percentage of weight loss indicates that the sample is more resistant to abrasive forces.

TABLE II

| EX | WT | ST | 1 hr/TS | 3 hr/TS | 24 hr/TS | AR |
|---|---|---|---|---|---|---|
| 7 | 6 | 13 | 65 | 310 | 329 | 1.7 |
| 8 | 5 | 13 | 60 | 332 | 459 | 0.9 |

Table II shows that the transverse strengths were improved in the samples made from the binder system containing the chromite flour, and the abrasion resistance increased significantly as reflected by the decrease in the weight loss.

We claim:

1. An inorganic foundry binder system comprising as separate Part A and Part B components:

A. an aqueous solution of a phosphoric acid selected from the group consisting of orthophosphoric acid, pyrophosphoric acid, trimetaphosphoric acid, tetrametaphosphoric acid, polyphosphoric acid, and mixtures thereof; and B. a mixture comprising:

(1) an iron oxide selected from the group consisting of:

(a) ferrous oxide, (b) ferroferric oxide, and (c) mixtures thereof and (2) magnesium oxide, wherein the weight ratio of iron oxide to magnesium oxide in the Part B component is from 1:9 to 9:1 and the weight ratio of the Part A component to Part B component is from 5:1 to 1:1.

2. The binder system of claim 1 wherein the phosphoric acid of the Part A component is orthophosphoric acid.

3. The binder system of claim 2 wherein the magnesium oxide of the Part B component is a refractory form of magnesium oxide.

4. The binder system of claim 3 wherein the magnesium oxide is dead-burned magnesite.

5. The binder system of claim 4 wherein the weight ratio of iron oxide to magnesium oxide in the Part B component is from 1:1 to 1:4.

6. The binder system of claim 5 wherein the aqueous solution of orthophosphoric acid is from 50 weight percent to 70 weight percent of orthophosphoric acid, said weight based upon the total weight of the acid and water in the aqueous solution.

7. The binder system of claim 6 wherein the weight ratio of the Part A component to Part B component is from 3:1 to 2:1.

8. The binder system of claim 7 wherein the aqueous solution of orthophosphoric acid is from 55 weight percent to 65 weight percent of orthophosphoric acid, said weight based upon the total weight of the acid and water in the aqueous solution.

9. The binder system of claim 8 wherein Part A of the binder system further contains polyvinyl alcohol in an amount of from 1 to 6 weight percent based upon the total weight of the Part A component.

10. The binder system of claim 9 wherein Part B of the binder system further contains a chromite in an amount effective to improve the abrasion resistance of the foundry mix prepared with the binder system.

11. The binder system of claim 10 wherein chromite is chromite flour in amount of 1 to 3 weight percent based upon the weight of the aggregate.

12. An inorganic foundry binder comprising in admixture:

A. an aqueous solution of a phosphoric acid selected from the group consisting of orthophosphoric acid, pyrophosphoric acid, trimetaphosphoric acid, tetrametaphosphoric acid, polyphosphoric acid, and mixtures thereof; and B. a mixture comprising:

(a) an iron oxide selected from the group consisting of:

(i) ferrous oxide, (ii) ferroferric oxide, and (iii) mixtures thereof; and (b) magnesium oxide, wherein the weight ratio of iron oxide to magnesium oxide in the Part B component is from 1:9 to 9:1 and the weight ratio of the Part A component to Part B component is from 5:1 to 1:1.

13. The binder of claim 12 wherein the phosphoric acid of the Part A component is orthophosphoric acid.

14. The binder system of claim 12 wherein the magnesium oxide of the Part B component is a refractory form of magnesium oxide.

15. The binder of claim 14 wherein the magnesium oxide is dead-burned magnesite.

16. The binder of claim 15 wherein the weight ratio of iron oxide to magnesium oxide in the Part B component is from 1:1 to 1:4.

17. The binder of claim 16 wherein the aqueous solution of orthophosphoric acid is from 50 weight percent to 70 weight percent of orthophosphoric acid, said weight based upon the total weight of acid and water in the aqueous solution.

18. The binder of claim 17 wherein the weight ratio of the Part A component to Part B component is from 3:1 to 2:1.

19. The binder of claim 1 wherein the aqueous solution of orthophosphoric acid is from 55 weight percent to 65 weight percent of orthophosphoric acid, said weight based upon the total weight of acid and water in the aqueous solution.

20. The binder of claim 19 wherein Part A of the binder system further polyvinyl alcohol in an amount of from 2 to 6 weight percent based upon the total weight of the Part A component.

21. The binder of claim 20 wherein Part B of the binder system further contains chromite in an amount effective to improve the abrasion resistance of the foundry mix prepared with the binder system.

22. The binder of claim 21 wherein the chromite is chromite flour in amount of 1 to 3 weight percent based upon the weight of the aggregate.

23. A foundry mix comprising in admixture:

(a) a foundry aggregate; and (b) a foundry binder system in an amount of from 1:100 to 10:100 parts by weight based upon the weight of the aggregate comprising:

(1) an aqueous solution of a phosphoric acid selected from the group consisting of orthophosphoric acid, pyrophosphoric acid, trimetaphosphoric acid, tetrametaphosphoric acid, polyphosphoric acid, and mixtures thereof; and (2) a mixture comprising:

(a) an iron oxide selected from the group consisting of:

(i) ferrous oxide, (ii) ferroferric oxide, and (iii) mixtures thereof; and (b) magnesium oxide, wherein the weight ratio of iron oxide to magnesium oxide in the Part B component is from 1:9 to 9:1 and the weight ratio of the Part A component to Part B component is from 5:1 to 1:1.

24. The mix of claim 23 wherein the phosphoric acid of the Part A component is orthophosphoric acid.

25. The mix of claim 24 wherein the magnesium oxide of the Part B component a refractory form of magnesium oxide.

26. The mix of claim 25 wherein the weight ratio of the Part A component to Part B component is from 5:1 to 1:1.

27. The mix of claim 26 wherein the magnesium oxide is dead-burned magnesite.

28. The mix of claim 27 wherein the weight ratio of iron oxide to magnesium oxide in the Part B component is from 1:1 to 1:4.

29. The mix of claim 28 wherein the aqueous solution of orthophosphoric acid is from 50 weight percent to 70 weight percent of orthophosphoric acid, said weight based upon the total weight of acid and water in the aqueous solution.

30. The mix of claim 29 wherein the weight ratio of the Part A component to Part B component is from 3:1 to 2:1.

31. The mix of claim 30 wherein the weight ratio of binder to aggregate is from 3:100 to 10:100.

32. The mix of claim 31 wherein the aqueous solution of orthophosphoric acid is from 55 weight percent to 65 weight percent of orthophosphoric acid, said weight based upon the total weight of acid and water in the aqueous solution.

33. The mix of claim 32 wherein Part A of the binder system further contains polyvinyl alcohol in an amount of from 1 to 6 weight percent based upon the total weight of the Part A component.

34. The mix of claim 33 wherein Part B of the binder system further contains chromite in an amount effective to improve the abrasion resistance of the foundry mix prepared with the binder system.

35. The mix of claim 34 wherein the chromite is chromite flour in amount of 1 to 3 weight percent based upon the weight of the aggregate.

* * * * *